US011510293B1

(12) United States Patent
Rezeanu et al.

(10) Patent No.: US 11,510,293 B1
(45) Date of Patent: Nov. 22, 2022

(54) DALI LINE-FAILURE-BASED DRIVER DIMMING MODE DETECTION VIA LOAD POWER MEASUREMENT

(71) Applicant: ABL IP HOLDING LLC, Conyers, GA (US)

(72) Inventors: Stefan-Cristian Rezeanu, Greenville, SC (US); James Robert Burt, Columbus, OH (US); Vaske Mikani, Atlanta, GA (US)

(73) Assignee: ABL IP HOLDING LLC, Conyers, GA (US)

( * ) Notice: Subject to any disclaimer, the term of this patent is extended or adjusted under 35 U.S.C. 154(b) by 0 days.

(21) Appl. No.: 17/531,126

(22) Filed: Nov. 19, 2021

(51) Int. Cl.
*H05B 45/30* (2020.01)
*H05B 47/17* (2020.01)
*H05B 45/14* (2020.01)

(52) U.S. Cl.
CPC ..... *H05B 45/14* (2020.01); *H05B 47/17* (2020.01)

(58) Field of Classification Search
CPC ..... H05B 45/00; H05B 45/10; H05B 45/14; H05B 45/30; H05B 47/00; H05B 47/17; H05B 47/18
See application file for complete search history.

(56) References Cited

U.S. PATENT DOCUMENTS 9,370,057 B2 6/2016 Saes et al.
9,538,614 B2 * 1/2017 Dhingra ..... H05B 47/10
9,820,361 B1 11/2017 Turvy, Jr. et al.
10,470,279 B1 11/2019 Fultz et al.
11,171,699 B2 11/2021 Fultz et al.
2017/0064796 A1 * 3/2017 Rumer ..... H05B 47/19
2019/0132923 A1 * 5/2019 Rumer ..... H05B 45/22
2021/0259080 A1 * 8/2021 Dina ..... H05B 47/175

OTHER PUBLICATIONS

IEC 62386-102, Edition 2.0, Nov. 2014, © IEC 2014, International Standard, "Digital Addressable Lighting Interface—Part 102: General requirements—Control Gear," Section 9, pp. 20-47.

* cited by examiner

*Primary Examiner* — Thai Pham
(74) *Attorney, Agent, or Firm* — RatnerPrestia

(57) ABSTRACT

An automatic driver-dimming-mode detection protocol includes subjecting, via a dimming bus, a luminaire driver to a first driver control signal of test analog voltages. Forcing the luminaire driver, via the first driver control signal, into a power output response that includes: (a) a constant output power mode, or (b) at least two discernable different output power levels. Detecting a dimming mode of the luminaire driver. The step of detecting the dimming mode of the luminaire driver includes: measuring, via a power metering circuit, a power metering measurement corresponding to the power output response; and based on the power metering measurement of the luminaire driver being: (a) the constant output power mode, determining that the luminaire driver is a digital dimming mode type (e.g., DALI), or (b) the at least two discernable different output power levels, determining that the luminaire driver is an analog dimming mode type (e.g., 0-10V).

20 Claims, 7 Drawing Sheets

Commissioning /Maintenance App
22
Commissioning Network 2
25
Mobile Device
Lighting Control System 1
On-Premises
Off-Premises
Luminaire 110A
10A
Luminaire Driver (e.g., DALI Protocol)
Dimming Controller
115
Light Source
120
Zone/Group Monitor
Wireless Lighting Control Network 5
Luminaire 110B
10B
Luminaire Driver (e.g., 0-10 V Protocol)
Dimming Controller
115
Light Source
120
60
55
WAN
65
50
Gateway

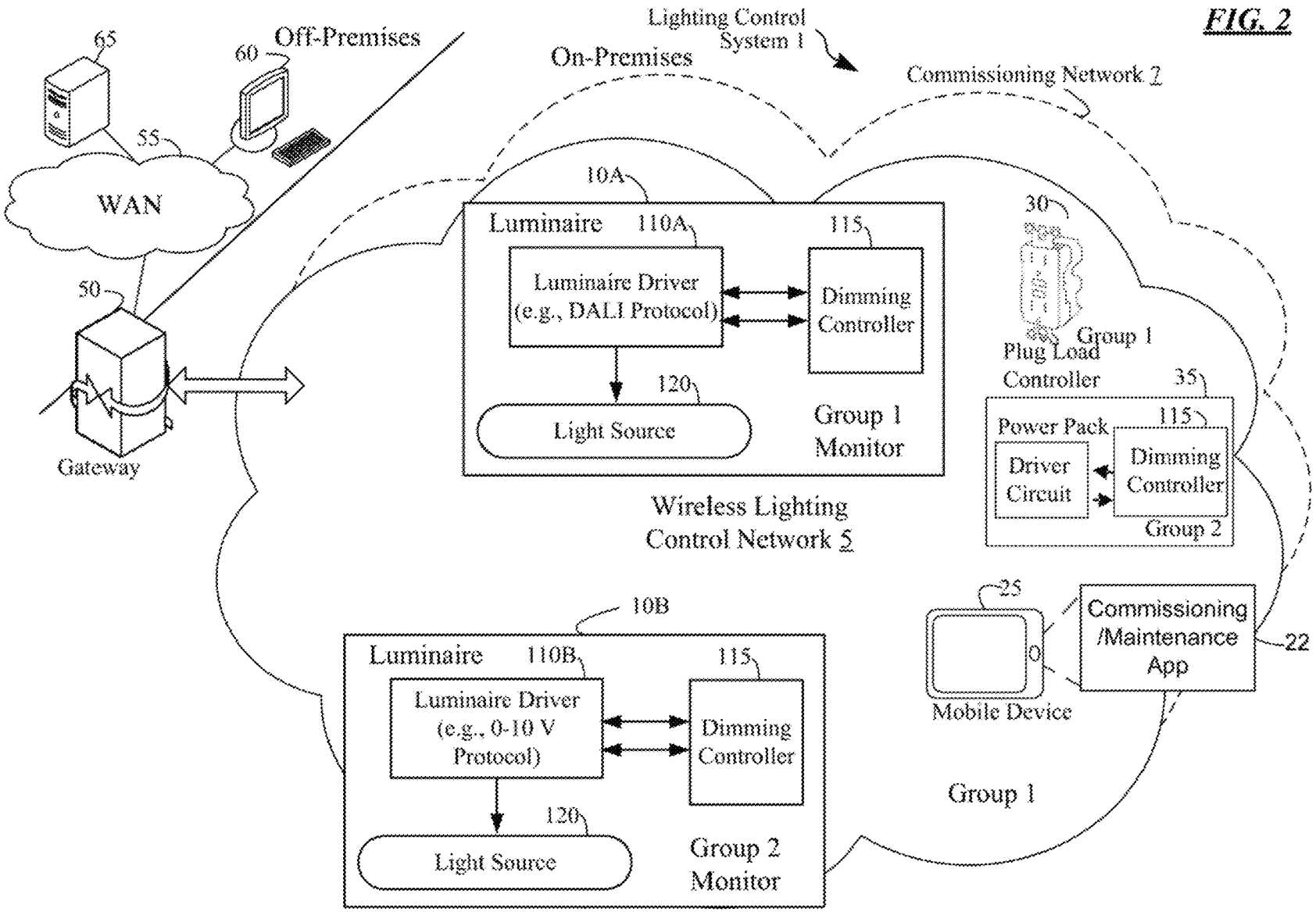
FIG. 2
Lighting Control System 1
On-Premises
Off-Premises
Commissioning Network 2
Wireless Lighting Control Network 5
Luminaire
10A
Luminaire Driver (e.g., DALI Protocol)
110A
Dimming Controller
115
Light Source
120
Group 1 Monitor
Luminaire
10B
Luminaire Driver (e.g., 0-10 V Protocol)
110B
Dimming Controller
115
Light Source
120
Group 2 Monitor
Group 1
Group 1 Plug Load Controller
30
Power Pack
35
Driver Circuit
Dimming Controller
115
Group 2
Mobile Device
25
Commissioning /Maintenance App
22
Gateway
50
WAN
55
60
65

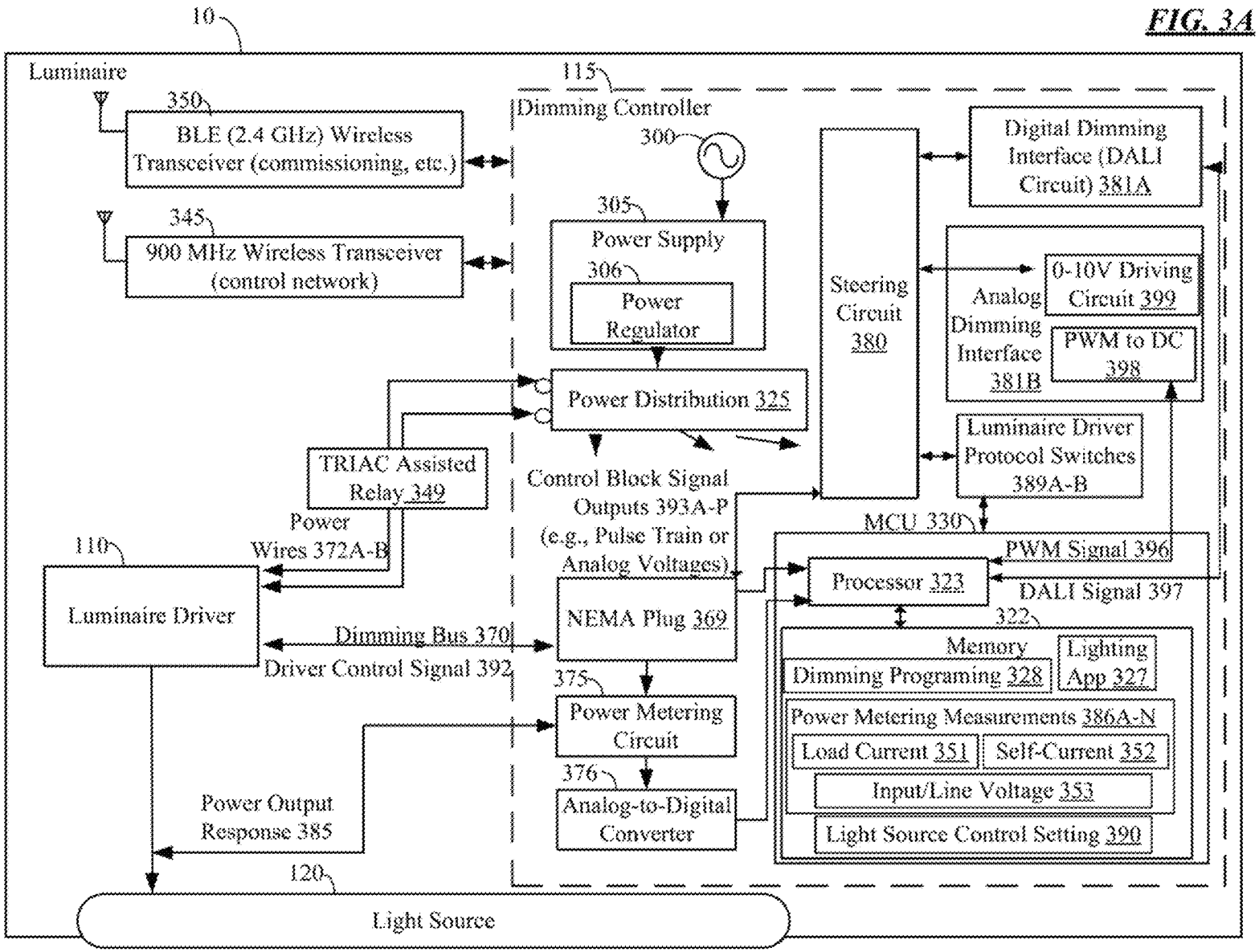
FIG. 3A
10
Luminaire
115
Dimming Controller
300
305
Power Supply
306
Power Regulator
Digital Dimming Interface (DALI Circuit) 381A
0-10V Driving Circuit 399
PWM to DC 398
Analog Dimming Interface 381B
Luminaire Driver Protocol Switches 389A-B
Steering Circuit 380
MCU 330
PWM Signal 396
DALI Signal 397
Processor 323
322
Memory
Lighting App 327
Dimming Programing 328
Power Metering Measurements 386A-N
Load Current 351
Self-Current 352
Input/Line Voltage 353
Light Source Control Setting 390
Power Distribution 325
Control Block Signal Outputs 393A-P (e.g., Pulse Train or Analog Voltages)
NEMA Plug 369
375
Power Metering Circuit
376
Analog-to-Digital Converter
350
BLE (2.4 GHz) Wireless Transceiver (commissioning, etc.)
345
900 MHz Wireless Transceiver (control network)
TRIAC Assisted Relay 349
Power Wires 372A-B
Dimming Bus 370
Driver Control Signal 392
110
Luminaire Driver
Power Output Response 385
120
Light Source

DALI LINE-FAILURE-BASED DRIVER DIMMING MODE DETECTION VIA LOAD POWER MEASUREMENT

BACKGROUND

Traditional luminaires can be turned ON and OFF, and in some cases may be dimmed, usually in response to user activation of a relatively simple input device, such as a light switch. Often, traditional luminaires are controlled individually or as relatively small groups at separate locations. Each or a group of the light sources in a luminaire are driven ON and OFF or dimmed by a luminaire driver, e.g., for a light emitting diode (LED) light source, or a ballast, e.g., for a fluorescent light source.

Unfortunately, the luminaire driver will typically be produced in different variants. In the case of an LED light source, for example, each variant of the luminaire driver typically only supports a single lighting control protocol, such as digital addressable lighting interface (DALI), 0-10 Volts (V), digital multiplex signal (DMX), one-wire universal asynchronous receiver/transmitter (UART)— e.g., light emitting diode (LED) code values, etc. When the luminaire does actually support multiple protocols, often users must perform some configuration step to manually switch the luminaire into the desired protocol.

In the past, supporting the dimming for digital (e.g., DALI) and analog (e.g., 0-10V) types of dimming luminaire drivers required different hardware in the control of a luminaire. Moreover, a customer would specify which dimming variant of the pair of control interface and dimming luminaire driver they wished to purchase for the chosen luminaire. Hence, there is a desire and need from the market to have a single control block in the luminaire that is able to handle both 0-10V and DALI dimming luminaire drivers. With this capability, there exists the need to detect which type of luminaire driver the luminaire has.

An exemplary prior art is described in U.S. Pat. No. 9,538,614 naming Vijay Dhingra as the inventor, issued on Jan. 3, 2017. This prior art method of detecting the driver dimming-mode (between DALI and 0-10V) consists of sending a DALI signal (forward frame) on the dimming bus and listening to the response on the same bus. If the driver responds with a DALI signal (backward frame), the "DALI dimming mode" decision is made. However, there are several deficiencies. First, the default idle voltage for a DALI bus is 16V, but can be as high as 16+6.5=22.5V, which can overstress a potential 0-10V dimming luminaire driver. Second, if the driver has a 0-10V dimming interface, there is no way to determine whether it has a linear (LIN) or logarithmic (LOG) dimming curve response.

An automatic driver dimming mode detection controller and protocol is needed to overcome these and other limitations in the art.

SUMMARY

As described herein, a dimming controller 115 automatically detects the luminaire driver dimming mode between DALI and 0-10V, and for the latter it also allows the discrimination between the most common linear (LIN) 450 dimming curve and logarithmic (LOG) 400 response. The above is accomplished by subjecting a dimming bus 370 to a couple of extreme test analog voltage levels in a voltage range (0V-6.5V) that forces a potential DALI-luminaire driver 110A into a constant output-power mode after 500-550 ms (because of the DALI "line-failure" feature), while a potential 0-10V luminaire driver 110B will respond with at least two discernable different output power levels, resolvable via a power metering measurement 386. Advantageously, a customer does not need to know whether the installation site uses a DALI luminaire driver 110A or a 0-10V luminaire driver 110B. The dimming controller 115 is installed on sites that use a DALI luminaire driver 110A or a 0-10V luminaire driver 110B, and is luminaire-driver-dimming mode insensitive and "plug and play." For example, the dimming controller 115 is plugged into a street lamp/light.

The prior art method of detecting the driver dimming-mode (between DALI and 0-10V) consists of sending a DALI signal (forward frame) on the dimming bus and listening to the response on the same dimming bus. However, the prior art is not checking the power measurement path. If the driver responds with a DALI signal (backward frame), the "DALI dimming mode" decision is made in the prior art.

When compared to automatic driver dimming mode detection protocol described herein, there are at least two deficiencies in the prior art (U.S. Pat. No. 9,538,614). First, the prior art overstresses a potential 0-10V type of luminaire driver 110B, because the default idle voltage for a DALI dimming bus 370 is 16V (but can be as high as 16+6.5=22.5V) that will be presented to the 0-10V type of luminaire driver 110B during the test. Second, there is no way the prior art can determine whether the potential 0-10V dimming interface has a LOG dimming curve 400 or LIN dimming curve 450 response as shown in FIG. 4.

BRIEF DESCRIPTION OF THE DRAWINGS

The drawing figures depict one or more implementations in accordance with the present teachings, by way of example only, not by way of limitation. In the figures, like reference numerals refer to the same or similar elements.

FIG. 2 is another high-level functional block diagram of an example of a lighting control system of networks and devices that further includes a plug load-controller and power pack devices and various lighting control groups.

FIG. 3A is a block diagram of a luminaire that communicates via the lighting control system of FIGS. 1-2 and is supported by the on/off and dimming controller to ensure compatibility with various types of luminaire drivers.

DETAILED DESCRIPTION

Figure 1:
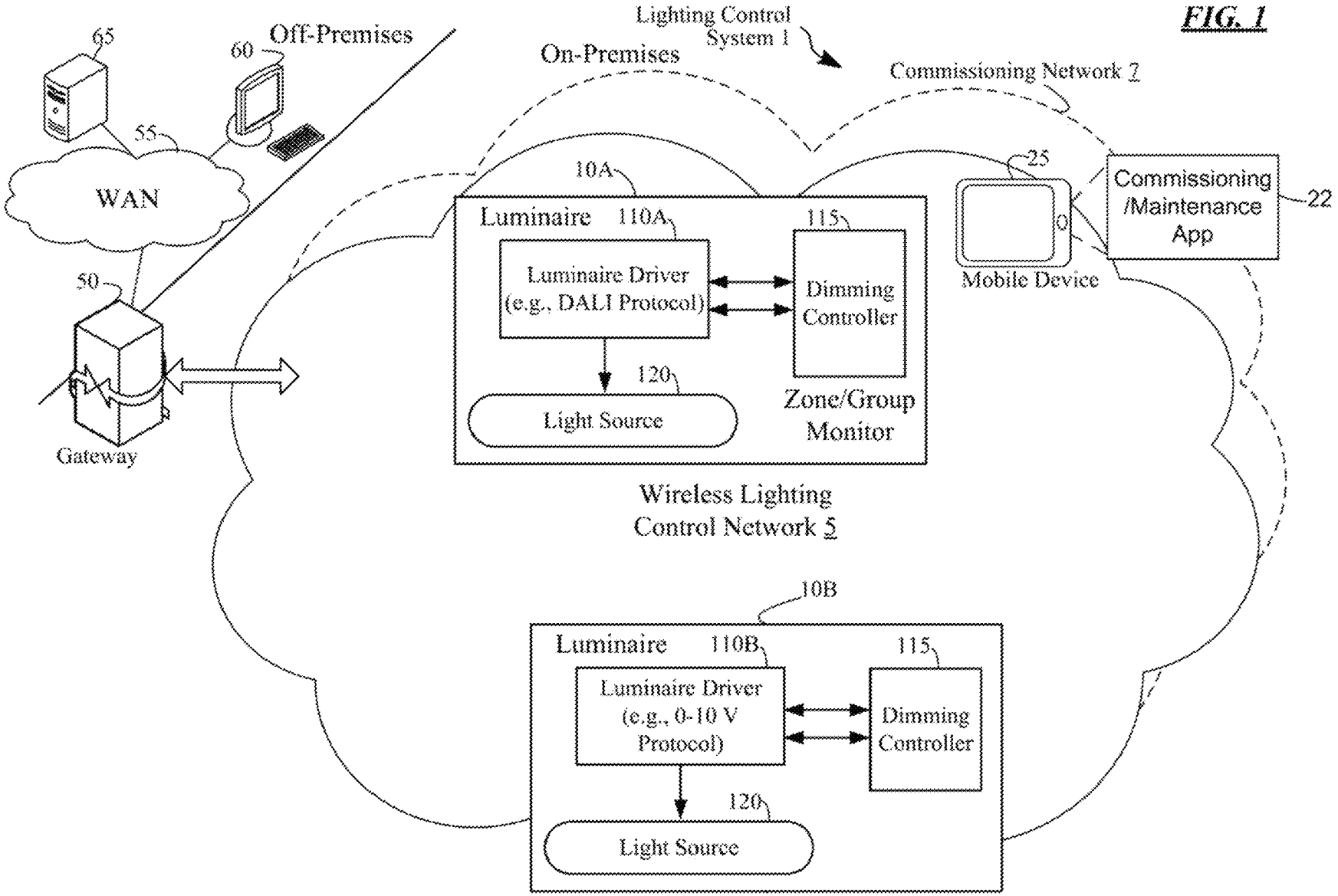
FIG. 1 is a high-level functional block diagram of an example of a lighting control system of networks and devices, including luminaires with various types of luminaire drivers with different types of luminaire driver protocols supported by a dimming controller and a mobile device.

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings.

The term "luminaire," as used herein, is intended to encompass essentially any type of device that processes energy to generate or supply artificial light, for example, for general illumination of a space intended for use of occupancy or observation, typically by a living organism that can take advantage of or be affected in some desired manner by the light emitted from the device. However, a luminaire may provide light for use by automated equipment, such as sensors/monitors, robots, etc. that may occupy or observe the illuminated space, instead of or in addition to light provided for an organism. However, it is also possible that one or more luminaires in or on a particular premises have other lighting purposes, such as signage for an entrance or to indicate an exit. In most examples, the luminaire(s) illuminate a space or area of a premises to a level useful for a human in or passing through the space, e.g., of sufficient intensity for general illumination of a room or corridor in a building or of an outdoor space such as a street, sidewalk, parking lot or performance venue. The actual source of illumination light in or supplying the light for a luminaire may be any type of artificial light emitting device, several examples of which are included in the discussions below.

Terms such as "artificial lighting" or "illumination lighting" as used herein, are intended to encompass essentially any type of lighting that a device produces light by processing of electrical power to generate the light. A luminaire for an artificial lighting or illumination lighting application, for example, may take the form of a lamp, light fixture, or other luminaire arrangement that incorporates a suitable light source, where the lighting device component or source(s) by itself contains no intelligence or communication capability. The illumination light output of an artificial illumination type luminaire, for example, may have an intensity and/or other characteristic(s) that satisfy an industry acceptable performance standard for a general lighting application.

The term "coupled" as used herein refers to any logical, optical, physical or electrical connection, link or the like by which signals or light produced or supplied by one system element are imparted to another coupled element. Unless described otherwise, coupled elements or devices are not necessarily directly connected to one another and may be separated by intermediate components, elements or communication media that may modify, manipulate or carry the light or signals Reference now is made in detail to the examples illustrated in the accompanying drawings and discussed below.

FIG. 1 is a high-level functional block diagram of an example of a lighting control system 1 of networks and devices, including luminaires 10A-B (light fixtures) with various types of luminaire drivers 110A-B with different types of luminaire driver protocols supported by a (on/off and) dimming controller 115. As used herein, a light source control setting 390 controls the light source 120, including, for example, by turning the light source 120 on/off, dimming up/down, setting a scene (e.g., a predetermined light setting), and can be based on sensor trip events. FIG. 2 is the same as FIG. 1, but further includes a plug load-controller 30 and a power pack 35; and illustrates exemplary lighting control groups for controlling the light source control setting 390 of the light source 120 of the luminaire 10A-B via the wireless lighting control network 5.

For purposes of communication and control, each luminaire 10A-B is treated as single addressable device that can be configured to operate as a member of one or more lighting control groups or zones in communication via a wireless lighting control network 5. Detector(s), such as daylight, occupancy, and audio sensors can be embedded in luminaires 10A-B, plug load-controller 30, or power pack 35 to enable controls for occupancy and dimming. Lighting control system 1 may be designed for indoor commercial spaces or outdoor spaces, such as street lamps/lights. Lighting control system 1 further includes a mobile device 25 with a commissioning and/or maintenance application 22 to commission the luminaires 10A-B, plug load-controller 30, and power pack 35 for transmission and reception of light source control settings 390 via the wireless lighting control network 5.

Light source 120 includes electrical-to-optical transducers include various light emitters, although the emitted light may be in the visible spectrum or in other wavelength ranges. Suitable light generation sources include various conventional lamps, such as incandescent, fluorescent or halide, low or high pressure sodium lamps; one or more light emitting diodes (LEDs) of various types, such as planar LEDs, micro LEDs, micro organic LEDs, LEDs on gallium nitride (GaN) substrates, micro nanowire or nanorod LEDs, photo pumped quantum dot (QD) LEDs, micro plasmonic LED, micro resonant-cavity (RC) LEDs, and micro photonic crystal LEDs; as well as other sources such as micro super luminescent Diodes (SLD) and micro laser diodes. Of course, these light generation technologies are given by way of non-limiting examples, and other light generation technologies may be used. For example, it should be understood that non-micro versions of the foregoing light generation sources can be used.

A lamp or "light bulb" is an example of a single light source 120. An LED light engine may use a single output for a single source but typically combines light from multiple LED type emitters within the single light engine. Light source 120 can include light emitting diodes (LEDs) that emit red, green, and blue (RGB) light or tunable white light. Many types of light sources provide an illumination light output that generally appears uniform to an observer, although there may be some color or intensity striations, e.g., along an edge of a combined light output. For purposes of the present examples, however, the appearance of the light source output may not be strictly uniform across the output area or aperture of the source. For example, although the source may use individual emitters or groups of individual emitters to produce the light generated by the overall source; depending on the arrangement of the emitters and any associated mixer or diffuser, the light output may be relatively uniform across the aperture or may appear pixelated to an observer viewing the output aperture. The individual emitters or groups of emitters may be separately controllable, for example to control intensity or color characteristics of the source output.

As shown, each luminaire 10A-B includes a light source 120 and different types of luminaire drivers 110A-B coupled to the light source 120. A first luminaire 10A includes a digital addressable lighting interface (DALI) luminaire driver 110A operating in accordance with DALI protocol between −6.5V-+22.5 V. A second luminaire 10B includes a 0-10 Volt (V) luminaire driver 110B operating in accordance with 0-10V dimming protocol, for example, utilizing low-pass filtered pulse width modulation (PWM) to deliver the necessary range of DC voltages.

Luminaire drivers 110A-B are coupled to the light source 120 and drive that light source 120 by regulating the power to the light source 120, for example, by providing a constant quantity or power (e.g., DC power output) to the light source 120 as its electrical properties change with temperature, for example. Luminaire drivers 110A-B may be a constant-voltage driver, constant-current driver, or AC LED driver type circuit that provides dimming through a pulse width modulation circuit (PWM) and may have many channels for separate control of light sources 120, including different LEDs or LED arrays. Luminaire drivers 110A-B can further include an alternating current (AC) or direct current (DC) current source or voltage source, a regulator, an amplifier (such as a linear amplifier or switching amplifier), a buck, boost, or buck/boost converter, or any other similar type of circuit or component. Luminaire drivers 110A-B can output a variable voltage or current to the light source 120 that may include a DC offset, such that its average value is nonzero, and/or an AC voltage. One example of a commercially available luminaire driver 110 is manufactured by EldoLED® and operates in accordance with a LEDCode luminaire driver control protocol.

As will be described in more detail in FIGS. 3A-C, the (on/off and) dimming controller 115 is coupled to the luminaire drivers 110A-B and configured to control light source 120 operation via the respective luminaire drivers 110A-B. Dimming controller 115 is compatible with a wide range of different types of luminaire drivers 110A-B, including, DALI between −6.5V-+22.5V, 0-10 V (e.g., low-pass filtered pulse width modulation— PWM), one-wire UART communication (e.g., LEDCode), DMX, etc. When the dimming controller 115 is connected to the luminaire driver 110A-B, the dimming controller 115 automatically determines the appropriate luminaire driver protocol (e.g., dimming signal) to be used for communication of the light source control setting 390.

Dimming controller 115 implements an automatic driver dimming mode detection protocol (between DALI and 0-10V), which is accomplished by subjecting a dimming bus (see element 370 of FIG. 3A) to a couple of extreme voltage levels in a voltage range that forces a potential DALI luminaire driver 110A in a constant output-power mode, while a potential 0-10V luminaire driver 110B will respond with at least two discernable different output power levels, resolvable via a power metering measurement (see element 386A-N of FIG. 3A). For the latter (i.e., a 0-10V luminaire driver 110B), the discrimination between a LOG dimming curve response 400 and LIN dimming curve 450 is also implemented by the dimming controller 115.

As shown in FIG. 3A, luminaires 10A-B, plug load-controller 30, and power pack 35 communicate control over a 900 MHz (sub-GHz, often centered on 915 MHz) wireless lighting control network 5 and accordingly each include a first radio transceiver 345 to communicate in the sub-GHz range of a first wireless communication band of the wireless lighting control network 5. A variety of controls are transmitted over wireless lighting control network 5, including, for example, to turn lights on/off, dim up/down, set scene (e.g., a predetermined light setting), and sensor trip events from detector(s). Each luminaire 10A-B, plug load-controller 30, and power pack 35 is also equipped with a second near range Bluetooth Low Energy (BLE) radio transceiver 350 that communicates over wireless commissioning network 7 for purposes commissioning and maintenance the wireless lighting control system 1, however no light source control settings pass over the wireless commissioning network 7. This second transceiver can be a two gigahertz or higher (often 2.4 GHz) band radio transceiver to communicate in a two GHz or higher range of a second wireless communication band of the wireless commissioning network 7. The respective frequencies of the two different wireless communication bands differ by at least a factor of two (2) (e.g., 900 MHz and 2.4 GHz; 2.4 GHz and 5 GHz; 900 MHz and 5 GHz).

Plug load-controller 30 plugs into existing AC wall outlets, for example, and allows existing wired lighting devices, such as table lamps or floor lamps that plug into a wall outlet, to operate in the lighting control system 1. The plug load-controller 30 instantiates the table lamp or floor lamp by allowing for commissioning and maintenance operations and processes wireless lighting controls in order to the allow the lighting device to operate in the lighting control system 1. Power pack 35 retrofits with existing wired light fixtures (luminaires 10A-B). The power pack 35 instantiates the wired light fixture by allowing for commissioning and maintenance operations and processes wireless lighting controls in order to allow the lighting device to operate in the lighting control system 1. Both plug load-controller 30 and power pack 35 can include the same circuitry, hardware, and software as luminaires 10A-B.

The lighting control system 1 is provisioned with a mobile device 25 that includes a commissioning/maintenance application 22 for commissioning and maintenance functions of the lighting control system 1. For example, mobile device 25 enables mobile commissioning, configuration, and maintenance functions and can be a PDA or smartphone type of device with human interfacing mechanisms sufficient to perform clear and uncluttered user directed operations. Mobile device 25 runs mobile type applications on iOS7, Android KitKat, and Windows 10 operating systems and commissioning/maintenance application 22 to support commissioning. Web enabled (cloud) services for facilitating commissioning and maintenance activities is also provided by mobile device 25. The commissioning/maintenance application 22 of mobile commissioning device 25 interfaces with the cloud services to acquire installation and configuration information for upload to luminaires 10A-B, plug load-controller 30, and power pack 35. The installation and configuration information is received by mobile device 25 from the gateway 50. The gateway 50 engages in communication through the wide area network (WAN) 55 for example, with various off-premises computing devices 60, 65.

Lighting control system 1 can leverage existing sensor and fixture control capabilities of Acuity Brands Lighting's commercially available nLight® wired product through firmware reuse. In general, Acuity Brands Lighting's nLight® wired product provides the lighting control applications. However, the illustrated lighting control system 1 includes a communications backbone and includes model transport, network, media access control (MAC) physical layer (PHY) functions. The sub-GHz communications of the wireless lighting control network 5 features are built on a near 802.15.4 MAC and PHY implementation with network and transport features architected for special purpose control and air time optimizations to limit chatter. The lighting control system 1 can be deployed in standalone or integrated environments. Lighting control system 1 can be an integrated deployment, or a deployment of standalone groups with no gateway 50. One or more groups of lighting control system 1 may operate independently of one another with no backhaul connections to other networks.

Lighting control system 1 may comprise a mix and match of various indoor systems, wired lighting systems (nLight® wired), emergency, and outdoor (dark to light) products that are networked together to form a collaborative and unified lighting solution. Additional control devices and lighting fixtures, gateway(s) 50 for backhaul connection, time sync control, data collection and management capabilities, and interoperation with the Acuity Brands Lighting's commercially available SensorView® product may also be provided.

As shown in FIG. 2, control, configuration, and maintenance operations of the lighting control system 1 involve networked collaboration between the luminaires 10A-B, plug load-controller(s) 30, and power pack(s) 35 that comprise a lighting control group. An installation is comprised of one or more lighting control groups each operating independently of one another. One or more lighting control groups may exist in the wireless lighting control network 5. Each lighting control group will have a group monitor, and this is shown in FIG. 2 where there are two groups and each group has a monitor.

Groups are formed during commissioning of the lighting control system 1 where all members of the group are connected together over wireless lighting control network 5, which in our example is a sub-GHz subnetwork defined by an RF channel and a lighting control group identifier. The luminaires 10A-B, plug load-controller 30, and power pack 35 subscribe to channels and only listen for/react to messages on the RF channel with the identifier (ID) of the subscribed channel that designates the lighting control group that the luminaire 10A-B, plug load-controller 30, and power pack 35 devices are a member of. For example, the devices subscribe to a multicast group as identified by the lighting control group identifier and only react to messages on the RF channel of the lighting control group. A group can be further divided to address control to specific control zones within the group defined by a control zone identifier. Zone communications are managed as addressable features at run time. Up to 16 independent zones of control are available for each group and each group can support up to 128 addressable elements (luminaires 10A-B, plug load-controller 30, power pack 35).

Further description of the plug load-controller 30, the power pack 35, commissioning over the wireless commissioning network 7, and communications of the wireless lighting control network 5 is found in U.S. Pat. No. 9,820,361, issued Nov. 14, 2017, titled "Wireless Lighting Control System," the contents of which is incorporated by reference for all purposes in its entirety as if fully set forth herein.

FIG. 3A is a block diagram of a luminaire 10 that communicates via the lighting control system of FIGS. 1-2 and is supported by the on/off and dimming controller 115 to ensure compatibility with various types of luminaire drivers 110A-B. Luminaire 10 can be an integrated light fixture that generally includes a power supply 305 driven by a power source 300. Power supply 305 receives power from the power source 300, such as an AC mains, battery, solar panel, or any other AC or DC source. Power supply 305 supplies power (in general voltages relative to Neutral or Ground) to the luminaire driver 110, wireless transceivers 345 and 350, drive/sense circuitry (not shown), and detector (s) (not shown) to provide reliable operation of the various circuitry of the luminaire 10.

Power supply 305 may include a magnetic transformer, electronic transformer, switching converter, rectifier, or any other similar type of circuit to convert an input power signal into a power signal suitable for luminaire 10. Power supply 305 includes a power regulator 306, which refers to the circuitry within the power supply 305 that stabilizes the output voltage(s) and/or current(s) to be unaffected by changes in the input voltage and loading. In the example, the luminaire driver 110 connects to the power supply 305 and the (on/off and) dimming controller 115 directly receives DC power from the luminaire driver 110 via auxiliary power lines, shown as power wires 372A-B which run through a triode for alternating current (TRIAC)-assisted relay load-control 349. Additionally, luminaire 10 also includes an on-board controller, shown as micro-controller unit (MCU) 330. The MCU 330 of luminaire 10 may receive detected sensor settings from on-board integrated detector(s), such as occupancy, audio, or daylight sensors connected via drive/sense circuitry. The detected sensor settings are utilized to adjust the light source control setting 390 of a light source 120.

The MCU 330 may be a microchip device that incorporates a processor 323 serving as the programmable central processing unit (CPU) of the MCU 330 as well as one or more memories, represented by memory 322. The memory 322 is accessible to the processor 323, and the memory or memories 322 store executable programming for the CPU formed by processor 323 as well as data for processing by or resulting from processing of the processor 323. The MCU 330 may be thought of as a small computer or computer like device formed on a single chip. Such devices are often used as the configurable control elements embedded in special purpose devices rather than in a computer or other general-purpose device. A variety of available MCU chips, for example, may be used as the MCU 330. It should be noted that a digital signal processor (DSP) or field-programmable gate array (FPGA) could be used as an alternative or in addition to the MCU 330.

The MCU 330 in this example also includes various input and output (I/O) interfaces, shown collectively by way of example as a NEMA plug 369. The NEMA plug provides an electrical and mechanical connection to the luminaire driver 110 and is a standardized type of connection across the lighting industry. NEMA plugs/sockets in light fixtures may have five or seven terminals or pins, for example three terminals used for power connection, the remaining two or four terminals are used to carry dimming signal and other signals (auxiliary voltage, occupancy sensor, serial interface, etc.). NEMA socket signal contacts can support a DALI type of luminaire driver 110A or a 0-10V type of luminaire driver 110B.

The NEMA plug 369 conveys control block signal outputs 393A-P (e.g., test analog voltages of the driver control signal 392 and regular operating dimming signals of the driver control signal 392) to the different types of luminaire drivers 110A-B. For example, the control block signal outputs 393A-P can include: (1) a first driver control signal 392A that includes test analog voltages 393A-P to determine the type of luminaire driver 110; or (2) a second driver control signal 392B that includes a pulse train or analog voltage (0-10V) to control/adjust dimming of the light source 120 once the type of luminaire driver 110 has been determined. The test analog voltages are outputted by an analog dimming interface 381B which is typically always selected for output by the steering circuit 380 during driver detection phase.

As shown, luminaire 10 includes a light source 120 and a luminaire driver 110 coupled to the light source 120. The luminaire driver 110 includes a dimming control bus 370. Dimming controller 115 is coupled to the luminaire driver 110 and configured to control light source 120 operation via the luminaire driver 110 based on the light source control setting 390.

MCU 330 of the luminaire 100 includes a processor 323, shown as CPU, and a memory 322 (e.g., volatile and non-volatile) accessible to the processor 323. As shown, memory 322 includes a lighting application 327 (which can be firmware) for both lighting control operations and commissioning, maintenance, and diagnostic operations.

Dimming controller 115 implements a power metering 375 circuit, which reads analog-output power metering measurements 386A-N detected at the electrical load (i.e., light source 120), such as load current 351, self-current 352, and input/line voltage 353. MCU 330 further includes dimming programming 328 (which can be firmware) in the memory 322. Generally, the dimming programming 328 takes two power metering measurements 386A-B and looks at an expected wattage change to detect a DALI type of dimming luminaire driver 110A or 0-10V type of luminaire driver 110B in the luminaire 10.

Execution of the dimming programming 328 by the processor 323 configures the luminaire 10 to perform the following functions. First, luminaire 10 subjects, via the dimming bus 370, the luminaire driver 110 to a first driver control signal 392A of test analog voltages. The first driver control signal 392A is a sequence of test analog voltages/signals to be applied to the dimming bus 370. The first driver control signal 392A is applied to ensure that the test analog voltages/signals presented on the dimming bus 370 are going to consistently and unfailingly force a potential DALI type of luminaire driver 110A in a constant output-power mode, while in the case of a potential 0-10V type of luminaire driver 110B, the 0-10V type of luminaire driver 110B will respond with at least two discernable different output power levels as the power metering measurements 386A-B.

Second, luminaire 10 forces the luminaire driver 110, via the first driver control signal 392A, into a power output response 385 that includes: (a) a constant output power mode, or (b) at least two discernable different output power levels. Third, the luminaire 10 detects a dimming mode of the luminaire driver 110. Fourth, in response to the detected dimming mode, the luminaire 10 outputs a second driver control signal 392B with regular operating dimming signals to the luminaire driver 110 based on the detected dimming mode.

The function to detect the dimming mode of the luminaire driver 110 includes the following two functions, which take measurements of the load (e.g., light source 120). First the dimming controller 115 measures, via a power metering circuit 375, a power metering measurement 386 corresponding to the power output response 385. The power metering circuit 375 conveys the power output response 385 of the luminaire driver 110 to an analog-to-digital converter 376 (included as part of a metrology chip 308), which results in a digital power metering measurement 386 being supplied to the CPU 323 of MCU 330 for processing. Second, based on the power metering measurement 386 of the luminaire driver 110 being: (a) the constant output power mode, the dimming controller 115 determines that the luminaire driver 110 is a digital dimming mode type; or (b) the at least two discernable different output power levels, the dimming controller 115 determines that the luminaire driver 110 is an analog dimming mode type. The constant output power mode produces a constant light output by the light source 120. The at least two discernable different output power levels produce a controllable and measurable light output variation by the light source 120.

Analog-to-digital converter 376 of the metrology chip 308 converts an analog input signal (power output response 385) through a mathematical function into a digital output signal (power metering measurements 386A-N) for processing by the processor 323 of the MCU 330. Analog-to-digital converter 376 can be a direct-conversion ADC, parallel comparator ADC, counter type ADC, servo tracking ADC, successive approximation ADC, integration ADC, delta-encoded ADC, pipelined ADC, etc. The metrology chip also ensures the power metering measurements 386A-N are stable, comparable, and accurate.

As further shown, the luminaire 10 further includes a steering circuit 380, a digital dimming interface 381A (e.g., DALI interface), and an analog dimming interface 381B (e.g., 0-10V). The function to output the driver control signal 392 to the luminaire driver 110 includes to: (a) based on the digital dimming mode type, select, via the steering circuit 380, the digital dimming interface 381A to output the second driver control signal 392B to the luminaire driver 110; or (b) based on the analog dimming mode type, select, via the steering circuit 380, the analog dimming interface 381B to output the driver control signal 392 to the luminaire driver 110. As shown in FIG. 3A, the analog dimming interface 381B includes a pulse width modulation (PWM) to direct current (DC) block 398 and a 0-10V driving circuit 399 to transform a PWM signal 396 received from MCU 330 to control block signal outputs 393A-P that are analog voltages for a 0-10V luminaire driver 110B. As further shown in FIG. 3A, the digital dimming interface (DALI circuit) 381A receives a DALI signal 397 from the MCU 330 and transforms the DALI signal 397 to control block signal outputs 393A-P that are a pulse train for a DALI luminaire driver 110A.

In a first example, the function to output the second driver control signal 392B to the luminaire driver 110 can further include to: in response to determining that the luminaire driver 110 is the digital dimming mode type, convey a DALI signal 397 to the digital dimming interface 381A; and select, via the steering circuit 380, a control block signal output 3930 of the digital dimming interface 381A that includes a pulse train to output as the second driver control signal 392B. For example, the digital dimming mode type of the luminaire driver 110 operates in accordance with a digital addressable lighting interface (DALI) protocol. In an alternative example, the function to output the driver control signal 392 to the luminaire driver 110 can further include to: in response to determining that the luminaire driver 110 is the analog dimming mode type, convey a pulse width modulation (PWM) signal 396 to the analog dimming interface 381B; and select, via the steering circuit 380, a control block signal output 393P of the analog dimming interface 381B that includes analog voltages to output as the second driver control signal 392B. For example, the analog dimming mode type of the luminaire driver 110 operates in accordance with a 0-10V dimming protocol.

As shown, steering circuit 380 connects to the DALI circuit (digital dimming interface 381A) and the 0-10V circuit (analog dimming interface 381B). Controlled by the application processor (MCU 330) executing the dimming programming 328, the steering circuit 380 selects only one of the outputs of the DALI circuit (digital dimming interface 381A) and the 0-10V circuit (analog dimming interface 381B) to be routed out to a NEMA plug to the luminaire driver 110. Essentially, the steering circuit 380 allows switching between the DALI and 0-10V dimming control types.

Steering circuit 380 routes out to the DIM+(NEMA-_pin_4) either the output of the digital dimming interface 381A (e.g., DALI section) or the output of the analog dimming interface 381B (0-10V section), based on the determination made by the dimming programming 328. The steering circuit 380 selects which dimming circuitry, shown as digital dimming interface 381A and analog dimming interface 381B, to use in controlling the dimming luminaire driver 110. The dimming programming 328 in the dimming controller 115 makes the decisions of what the type of luminaire driver 110 is based on the output (power metering measurements 386A-N). For example, the dimming programming 328 sets certain control points (test analog voltages as the control block signal outputs 393A-P) and reads measurement data (power metering measurements 386A-N). The steering circuit 380 typically selects the analog dimming interface 381B (not DALI) during the driver dimming detection phase in order to provide the test analog voltage levels. The dimming programming 328 detects the digital dimming mode type or analog dimming mode type, and then the steering circuit 380 chooses which of the analog or dimming interface 381A-B based on the detected dimming mode type. Selection of the digital or analog dimming interface 381A-B can be implemented via luminaire driver protocol switches 389A-B, which can be external or internal (e.g., integral) to the steering circuit 380.

Luminaire 10 also includes a dual-band wireless radio communication interface system configured for two-way wireless communication. It should be understood that "dual-band" means communications over two separate RF bands (e.g., any combination of sub-GHz, 2.4 GHz, 5 GHz). The communication over the two separate RF bands can occur simultaneously (concurrently); however, it should be understood that the communication over the two separate RF bands may not actually occur simultaneously. In our example, luminaire 10 has a radio set that includes radio 345 for sub-GHz communications and another radio 350 for Bluetooth RF communications. A first transceiver 345, such as a 900 MHz wireless transceiver, issues control operations on the wireless lighting control network 5. This first transceiver 345 is for any-to-many (unicast and multicast) communication over a first of the two different wireless communication bands, of control and systems operations information (e.g., light source control setting 390 operations), during luminaire operation and during control network operation over the first wireless communication band over the wireless lighting control network 5. Two transport methods ride on the network layer function of the first transceiver 345: unicast and multicast. The first transceiver 345 engages in multicast group communication of a one-to-many or a many-to-many distribution where group communication is addressed to a group simultaneously.

A second transceiver 350, such as a 2.4 GHz BLE (Bluetooth) wireless transceiver carries out commissioning, configuration, maintenance, and diagnostics of the lighting control network 5 by communicating over the wireless commissioning network 7. This second transceiver 350 is for point-to-point communication, over a second of the two different wireless communication bands over the wireless commissioning network 7, of information other than the control and systems operations information, concurrently with at least some communications over the first wireless communication band.

MCU 330 includes programming in the memory 322, which configures the processor 323 to control operations of the respective luminaire 10, including the communications over the two different wireless communication bands via the dual-band wireless radio communication interface system 345, 350. The programming in the memory 322 includes a real-time operating system (RTOS) and further includes the lighting application 327 which is firmware/software that engages in communications with the commissioning/maintenance application 22 of mobile device 25 over the wireless commissioning network 7 of FIGS. 1-2. The lighting application 327 programming in the memory 322 also carries out lighting control operations over the lighting control network 5 of FIGS. 1-2. The RTOS supports multiple concurrent processing threads for different simultaneous control or communication operations of the luminaire 10.

Figure 3B:
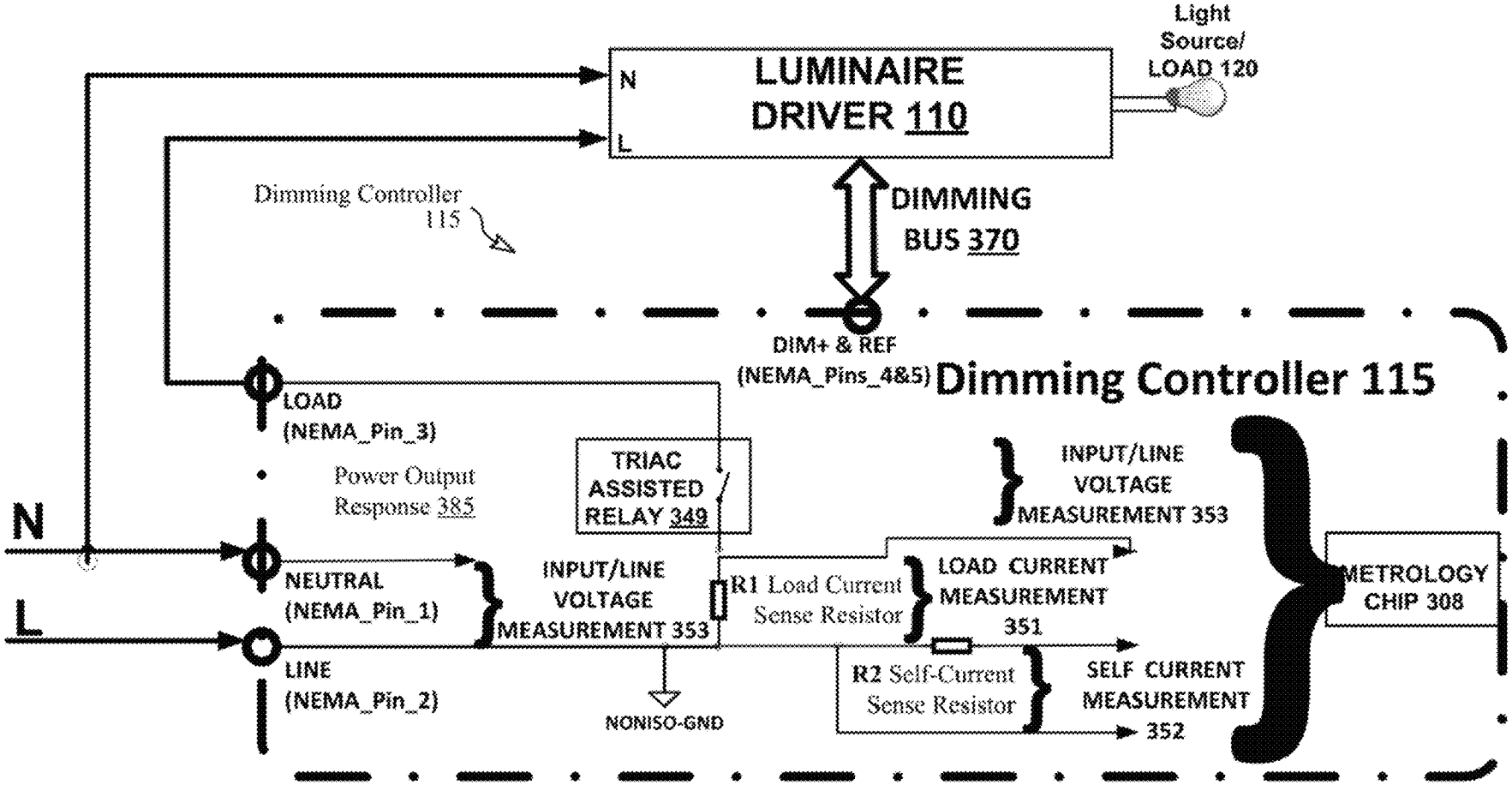
FIG. 3B is a block diagram that includes the (on/off and) dimming controller to implement a driver dimming mode detection protocol, including the circuits that enable power metering measurements.

FIG. 3B is a block diagram that includes the on/off and dimming controller 115 to implement a driver dimming mode detection protocol, on/off load-control, and the circuits that enable power metering measurements. Shown in FIG. 3B is the dimming bus 370 on which the test analog voltages 393A-P are applied, the load-control (TRIAC-assisted relay load-control 349 block), which is detailed in FIG. 3C, and the three power metering measurements/signals 386A-N inputted to a metrology chip 308. As noted above, the three metering measurements include: (1) load current 351, (3) self-current 352, and (3) input/line voltage 353.

To ensure the test analog voltages 393A-P presented on the dimming bus 370 are going to force a potential DALI-controlled (dimming) luminaire driver 110A in a constant output-power mode, while in the case of a potential 0-10V-controlled luminaire driver 110B, the driver will respond with two discernable different output power levels. The power levels are measured via load power measurements 386A-N in the metrology chip 308. Note that three measurements 386A-N are used in determining the total power (3 differential pairs=6 inputs, one pair for voltage 353 and two pairs for currents 351, 352). Those 6 inputs enter into the metrology chip 308 shown in FIG. 3C. The function to measure, via the power metering circuit 375, the power metering measurement 386 includes to: measure a load current 351 via a voltage drop on a first resistor; measure a self-current 352 via a voltage drop on a second resistor; measure an input/line voltage 353; or a combination thereof. The function to subject, via the dimming bus 370, the luminaire driver 110 to the first driver control signal 392 includes to: sequentially apply at least two test analog voltages 393A-B in a reduced voltage range of 0-6.5V as the first driver control signal 392A on the dimming bus 370.

To determine whether the luminaire driver 110 has a 0-10V dimming control or not, the dimming programming 328 sets a first test voltage level 393A of the first driver control signal 392A for the 0-10V dimming. The steering circuit 380 will select the output of the 0-10V analog dimming interface 381B to drive the dimming input of the dimming luminaire driver 110 via a NEMA plug 369. The analog dimming interface 381B produces a control block signal output (test analog voltage) 392A to be applied to the NEMA plug. As shown in FIGS. 3A-B, the control block signal output 393A is routed via the steering circuit 380. The dimming controller 115 has metering capability (via the power metering circuit 375 and metrology chip 308), which allows a first power metering measurement 386A of the wattage of the luminaire 110 at the electrical load (i.e., light source 120).

After the first power metering measurement 386A, the dimming programming 328 changes the first driver control signal 392A to a second test voltage level 393B on the 0-10V line of the analog dimming interface 381B. The analog dimming interface 381B produces a control block signal output (test voltage) 393B to be applied to the NEMA plug 369, which is routed through the steering circuit 380. The power metering circuit 375 measures the power level again at the electrical load (i.e., light source 120) as a second power metering measurement 386B. If the two measured power levels (power metering measurements 386A-B) are in a range that would indicate the 0-10V type of luminaire driver 110B was controlling the dimming of the light source 120, the dimming controller 115 would then utilize the 0-10V type of analog dimming interface 381B for dimming control by enabling luminaire driver protocol switch 389B. If this does not produce the expected wattage change, the dimming controller 115B can switch the steering circuit 380 to use the DALI type of digital dimming interface 381A for dimming of the luminaire 10 by enabling luminaire driver protocol switch 389A. The key to successful detection of the dimming type of the luminaire driver 110 by using this method is that the above levels of the at least two test analog voltages (from the 393A-P set) sent out via the 0-10V analog dimming interface 381B have to ensure that the "Interface Failure" condition is triggered if the connected dimming luminaire driver 110A is of the DALI type—in which case the power level at the load (i.e., light source 120) will stay constant (determined by the "System Failure Level") for the above two power metering measurements 386A-B.

The dimming controller 115 can use a DALI specified "System Failure Level" to determine if there is a DALI type of luminaire driver 110A connected. As mentioned above, the key to a successful detection is to trigger an "Interface Failure" condition if the connected dimming luminaire driver 110A is of the DALI type. For this to happen, the above at least two test analog voltages 393A-P set out as the driver control signal 392 via the 0-10V type of analog dimming interface 381B have to be lower than 6.5V (which is the highest DALI dimming bus 370 voltage that is associated with a binary-low logic level). Hence, to ensure the success of this method, the 0-10V output would be first set deliberately to a logic-low analog value in its high range (as specified in the DALI standard), such as 6-6.5 Volts as a first test analog voltage 393A, and then the dimming controller 115 with the metering capability via the power metering circuit 375 takes a first power metering measurement 386A.

Next, the dimming programming controller 115 would set the 0-10V output of the analog dimming interface 381B to a much lower analog value as a second test analog voltage 393B in the same logic low DALI range (e.g., 0-0.5V) and then take a second power metering measurement 386B. If the dimming controller 115 were connected to a DALI type of luminaire driver 110A, the difference in the two measured power metering measurements 386A-B would ideally be zero. In other words, if a DALI type of luminaire driver 110A were connected, the dimming controller 115 would find that the two power metering measurements 386A-B resulted in a consistent power reading (determined by the driver-stored 1-byte "System Failure Level" variable) despite the change in the 0-10V output from 6-6.5 Volts to 0-0.5V in the test analog voltages 393A-B of the first driver control signal 392. The dimming controller 115 would then enable DALI as the control method for dimming the luminaire 10. The dimming controller 115 can read the load current 351, self-current 352, and input/line voltage 353, and other measurement data as the power metering measurements 386A-N periodically from the power metering circuit 375. For this type of detection sequence of the luminaire driver 110, the power (watts) is used to make the decision on the type of luminaire driver 110. The order in which the two analog test voltages (6-6.5V and 0-0.5V in the above illustration) are presented to the Dimming Bus 370 is irrelevant.

In a first example, the detected dimming mode is the analog dimming mode type; and the function to detect the dimming mode of the luminaire driver 110 further includes to: based on the at least two discernable different output power levels, determine that the analog dimming mode type includes a LIN dimming curve 450 response. The function to determine that the analog dimming mode includes the LIN dimming curve 450 response is based on the at least two discernable different output power levels varying by approximately a factor of eight (8×) or approximately 20% or less. The function to determine that the analog dimming mode includes the LOG dimming curve 400 response is based on the at least two discernable different output power levels varying by approximately a factor of less than two (2×) or approximately 70% or more.

In a second example, the detected dimming mode is the digital dimming mode type; and the function to detect the dimming curve of the luminaire driver 110 further includes to: supplement the first driver control signal 392A with two additional test analog voltages 393C-D. The supplementation with the additional test analog voltages 393C-D can be: (1) either the same dimming levels corresponding to test analog voltages 393A-B of first driver control signal 392A, in which case the decision is made the same, based on 8× and <2×; or (2) much higher dimming levels than in the analog dimming case of test analog voltages 393A-B, such as direct arc forward frames, that will cause at least two discernable different output power levels varying by 20% or less for a LIN dimming curve 450 case and 70% or more in the LOG dimming curve 400 case. Hence, the two additional test analog voltages 393C-D are: (1) either the same dimming levels as the test analog voltages 393A-B previously applied; or (2) sufficiently high enough to cause at least two discernable different output power levels varying by 20% or less in a LIN case 450 and 70% or more in a LOG case 400.

As noted above, an exemplary prior art is described in U.S. Pat. No. 9,538,614, issued Jan. 3, 2017. The prior art method of detecting the driver dimming-mode (between DALI and 0-10V) consists of sending a DALI signal (forward frame) on the dimming bus and listening to the response on the exact same dimming bus. If the driver responds with a DALI signal (backward frame), the "DALI dimming mode" decision is made. When compared to the dimming controller 115 described herein, there are at least two deficiencies/drawbacks in the prior art: (1) the default idle voltage for a DALI dimming bus is 16V, but can be as high as 16+6.5=22.5V, which can overstress a potential 0-10V dimming luminaire driver; and (2) if the luminaire driver has a 0-10V dimming interface, there is no way to determine whether it has a LIN or LOG dimming curve response. Accordingly, the dimming controller 115 described herein remedies these and other deficiencies/drawbacks in the prior art.

Dimming programming 328 implements functions to ensure that the test analog voltages/signals 393A-P, e.g., first driver control signal 392A presented on the dimming bus 370 are going to force a potential DALI type of luminaire driver 110A in a constant output-power mode. While in the case of a potential 0-10V luminaire driver 110B, the dimming programming 328 ensures that the 0-10V type of luminaire driver 110B will respond with at least two discernable different output power levels in the power output response 385. The power levels are measured via power metering measurements 386-N. In the example, three measurements can be used to determine the total power metering measurement 386: (1) load current 351 (load consumption current); (2) self-current 352 (self-consumption current); and (3) and input/line voltage 353 (utility voltage level).

To comply with the conditions set in the above paragraph, the driver control signal 392 presented to the dimming bus 370 are at the intersection between the line-failure DALI logic_low (ranged between −6.5V and +6.5V) and the standard 0-10V range of the analog dimming: the resulting common voltage range will thus be 0V-6.5V. It follows that if two extreme levels of test analog voltages 393A-B within this range are sequentially generated by the dimming programming 328 and then applied (say one between 0-0.5V and the other one between 6-6.5V) the following will occur. First, a digital dimming interface 381A of a DALI type of luminaire driver 110A will detect a "line-failure" event after 500 ms for DALI 1.0 or after 550 ms for DALI 2.0 (the "Interface Failure" being described in Section 9.3 of the "Part 102" DALI 1.0 standard 62386-102, page 27/148 of the 2009 edition) and will respond with a constant output level as the control block signal output 393A (a single test analog voltage 393) determined by the specific 1-byte variable called "System Failure Level." Second, an analog dimming interface 381B will respond with at least two discernable different output levels as the control block signal outputs 393A-B (two test analog voltages 393A-B), resolvable via a power metering measurements 386A-N.

Moreover, a side benefit of performing the power metering measurements 386A-N for each applied level of test analog voltages 393A-P, allows for the easy identification of the LOG dimming curve 400 vs. LIN dimming curve 450 that may be characterizing the controlled luminaire driver 110. Specifically, the difference between the two power levels read out as the power metering measurements 386A-B for each of the at least two test analog voltages 393A-B applied on the dimming bus 370 as the first driver control signal 392A, enables the dimming programming 328 to detect whether the analog 0-10V type of luminaire driver 110B has a LOG dimming curve 400 or LIN dimming curve 450 response. Note that the light output of the light source 120 is reasonably considered to follow closely the output power level of the power metering measurements 386A-B. Hence, from the dimming curves 400, 450 shown in FIG. 4 the dimming programming 328 extrapolates to a 0-10V driver circuit 110B and safely derives that: (a) for a LIN dimming curve 450, the difference in the two power readings (power metering measurements 386A-B) will be roughly 8× (say between a 8% and a 63% in light output, or output power, corresponding to a shrunk ratio of about 160/20=8× in the dimming level, which is the extrapolation of the two test voltages on the 0-255 abscissa scale of FIG. 4). While (b) for a LOG scale dimming curve 400, the same 20 to 160 in dimming level will barely move the needle (maybe not even 2×) allowing a clear dimming curve type determination by the dimming programming 328 for the controlled luminaire driver 110.

The above illustrates the direct determination of the dimming curve 400, 450 for a 0-10V type of luminaire driver 110B, from the at least two test analog voltages 396A-B applied as the first driver control signal 392A to the dimming bus 370. However, once the DALI luminaire driver 110A vs. 0-10V luminaire driver 110B determination is made, if the luminaire driver 110 is a DALI type of luminaire driver 110A, then the dimming programming 328 and the steering circuit 380 can allow the digital dimming interface 381A to drive the control block signal outputs 393A-B, and two different DALI dimming levels can be applied as the control block signal outputs 393A-B per the dimming curves 400, 450 of FIG. 4 as the second driver control signal 392B. The dimming levels can be the same with the ones in the analog case (in which case the decision is made the same, based on 8× and <2×), but there is a second possibility in the digital case: if the dimming programming 328 applies an "around 200" and the other "around 250" on the abscissa of FIG. 4 (much higher dimming levels than in the analog dimming case), a linear (LIN) dimming curve 450 yields a mere 20% variation in output power, while a logarithmic (LOG) dimming curve 400 yields a much larger (almost 70%) corresponding variation in output power.

As briefly described above, the prior art has the merit of extreme simplicity, by sending a DALI signal (forward frame) on the dimming bus 370 and listening to the response (a potential backward frame in the case of a DALI type of luminaire driver 110A) on the very same dimming bus 370. But the prior art has two major drawbacks vs. the more complex dimming programming 328, that requires the ability of measuring the power consumption as the power metering measurements 386A-N. First, the default idle voltage for a DALI dimming bus is 16V, but can be as high as 16+6.5=22.5V, which can overstress a potential 0-10V type of dimming luminaire driver 110B. Second, if the luminaire driver 110B has a 0-10V dimming interface, by using the prior art method, there is no way to determine whether the 0-10V driver has a LOG dimming curve 400 or a LIN dimming curve 450 response.

As described herein, the first drawback of the prior art is eliminated by the dimming programming 328 by only subjecting the dimming bus 370 (during the initial test) to a much-reduced range of test analog voltages 393A-P (0-6.5V max). Hence, a dimming bus 370 of a potential 0-10V type of luminaire driver 110B is not stressed at all. The second drawback is eliminated by providing the ability to measure the power consumption (power metering measurements 386A-N of the load (light source 120) corresponding to the first driver control signal 392A (the sequentially applied test analog voltages 393A-P). Then based on the power metering measurements 386A-N, the dimming programming 328 determines the significantly different result between a LOG dimming curve 400 and LIN dimming curve 400 (see FIG. 4).

In other words, the dimming controller 115 solution overcomes the drawbacks of the prior art by "staging" (sequentially applying) at least two test analog voltages 393A-B in a reduced voltage range (of 0-6.5V) as the first driver control signal 392A on the dimming bus 370. The test analog voltages 393A-B can be potentially supplemented by two different direct arc forward frames in case the dimming interface 381A-B is deemed a digital dimming interface 381A (DALI type), for example, corresponding to say around 200 and around 250 "DALI Dimming Levels"—much higher dimming levels than in the analog dimming case— although they can be the same with the ones used in the analog case (in which case the decision is made the same, based on 8× and <2×).

Figure 3C:
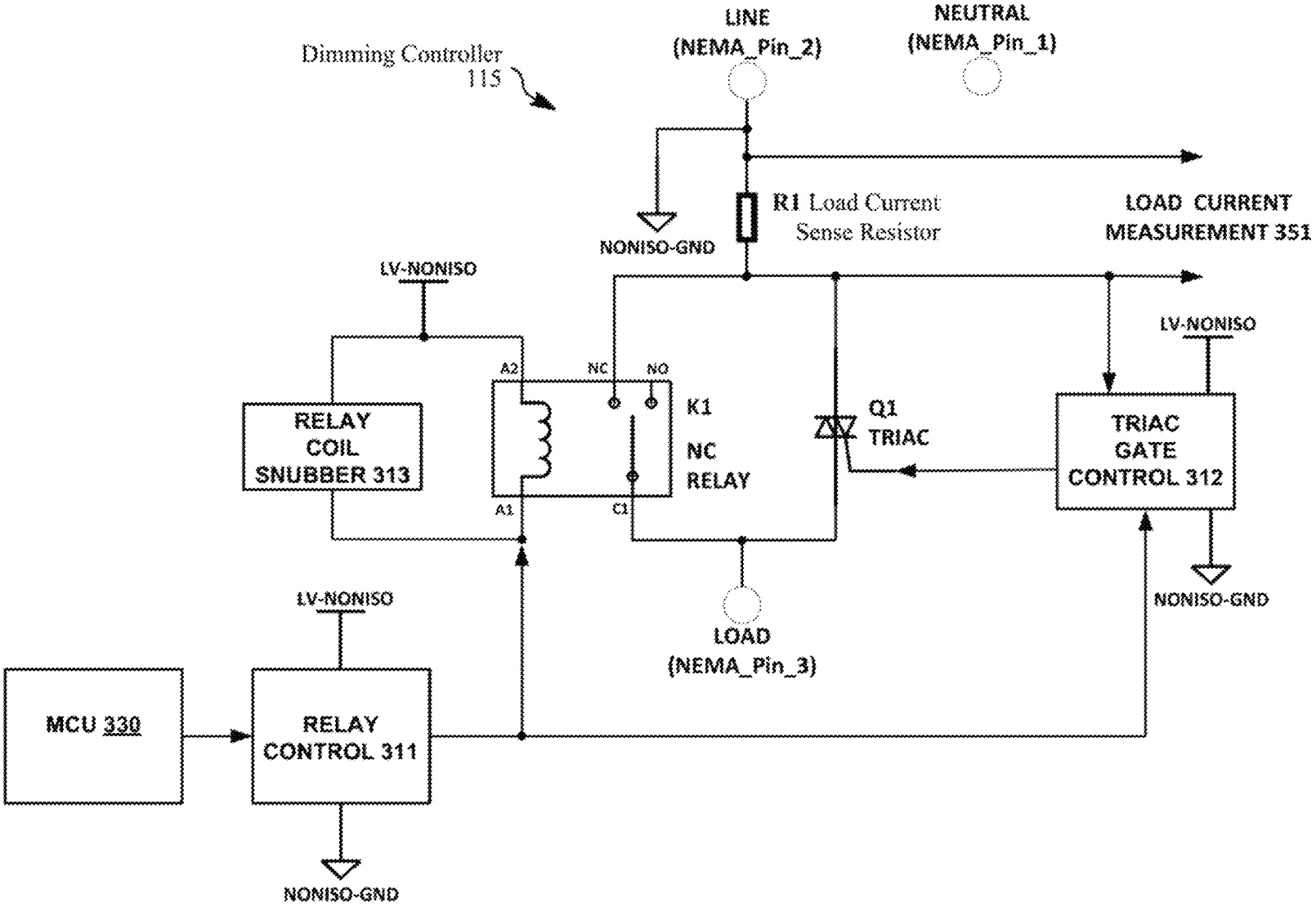
FIG. 3C shows an AC switching (load-control) circuit of the on/off and dimming controller associated with a TRIAC-assisted relay load-control, which is the circuit element that energizes the load (luminaire driver and light source).

FIG. 3C shows an AC switching circuit of the dimming controller 115 associated with a TRIAC-assisted relay load-control clock 349, which is the circuit element that energizes the load (luminaire driver 110 and light source 120). This circuit diagram shows the load measurement circuit (load current sensing circuit that allows measurement of the load current 351) of the power metering circuit 375. The power metering circuit 375 reads the power output response 385 that includes analog output power measurements detected at the load (i.e., light source 120). As shown in FIGS. 3B-C, part of the power metering measurements 386A-N include: (1) the load current 351 illustrated above, taken on the load current sense resistor R1; (2) self-current measurement 352 taken on the R2 sense resistor of FIG. 3B; and (3) an input/line voltage measurement 353.

The TRIAC gate control block 312 is controlled by a relay control 311 output signal and by the input/line voltage 353, coming via the load-current-sense resistor R1 used to sense load current 351 (traditionally this block may contain a photo-triac). In FIG. 3C, K1 is the relay (NC means normally closed) which is TRIAC-assisted (Q1). A relay coil snubber 313 is also shown and the MCU 330 drives the relay control 311 circuit. This control signal from the MCU 330 is sent across an isolation barrier.

To summarize, a first driver control signal 392A that includes analog voltage-level signals (first and second test analog voltages 393A-B) lower than 6.5V at the output of the steering circuit 380 forces an "Interface Failure" condition in a DALI luminaire driver 110A with a constant output light (determined by the DALI driver-stored 1-byte "System Failure Level" variable) as a consequence. On the other hand, the first driver control signal 392A that includes first and second test analog voltages 393A-B lower than 6.5V results in a controllable and measurable light output variation if a 0-10V dimming type of luminaire driver 110B is present. The "Interface Failure" condition is described in Section 9.3 in the "Part 102" DALI standard 62386-102 of DALI 1.0 (page 27/148, iec-62386-102-2009). In DALI 2.0 (iec62386-102-ed2-0-b_2014-11) the only change was the increase of the minimum 500 ms (bus low) to 550 ms, per Section 9.12: "System Failure" pointing to "IEC 62386-101: 2014, Subclause 4.11", where Table 4 (page 22/174) shows and 3.45 defines the "System Failure" as a power interruption >550 ms on page 16/174.

Figure 4:
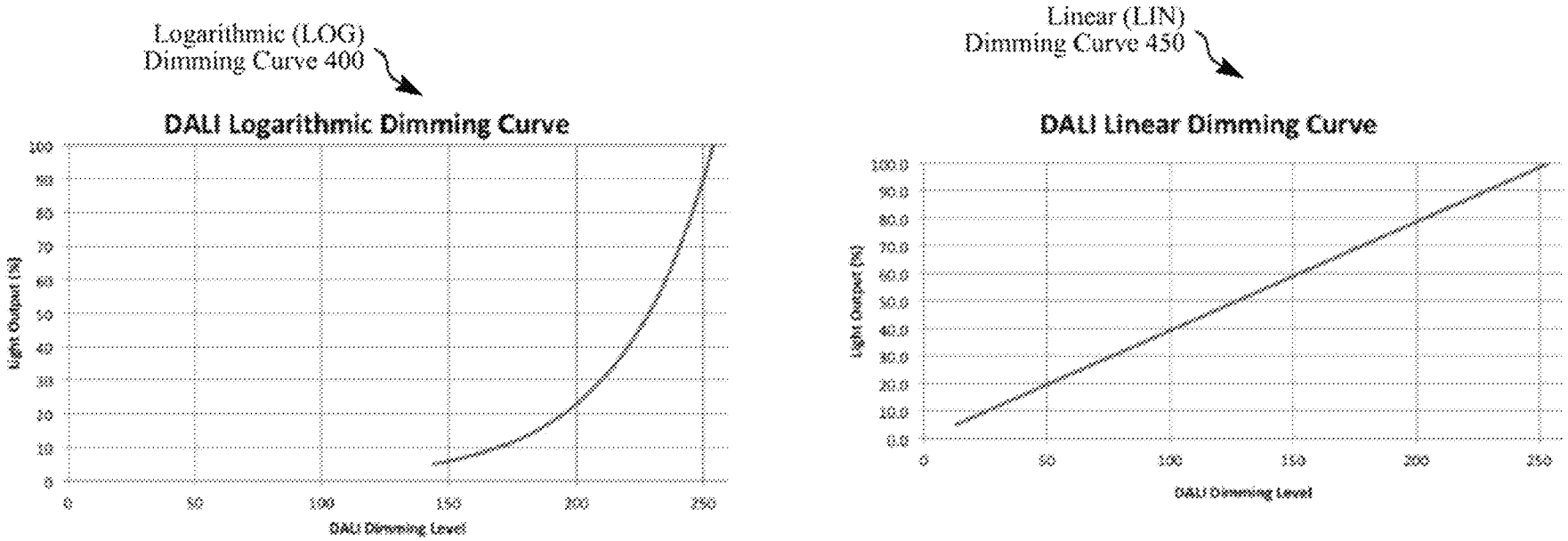
FIG. 4 depicts a logarithmic (LOG) dimming curve and a linear (LIN) dimming curve that illustrate the principle by which in the case of a DALI digital luminaire driver or a 0-10V analog luminaire driver, a determination is made on whether a potential 0-10V dimming type of luminaire driver has a LOG or LIN dimming curve response.

FIG. 4 depicts a LOG dimming curve 400 and a LIN dimming curve 450 that illustrate the principle by which in the case of a 0-10V type of luminaire driver 110B, a determination is made on whether a potential 0-10V dimming type of luminaire driver 110B has a LOG or LIN dimming curve response 400, 450. In the analog dimming case, the dimming level is obtained by the extrapolation of the two test voltages (<6.5V) in the 0-10V range on the 0-255 abscissa scale/range of FIG. 4. In addition, the same dimming curves 400, 450 are used if the determination is made by the dimming programming 328 that the luminaire driver 110A is a DALI type. For example, if an "around 200" signal for a first test analog voltage 393A and an "around 250" signal for a second test analog voltage 393B are applied as the first driver control signal 392, a LIN dimming curve 450 yields a mere 20% variation in output power (power output response 385), while a LOG dimming curve 400 yields a much larger (almost 70%) corresponding variation in output power (power output response 385), which is read by the power metering circuit 375 and produced as the power metering measurements 386A-N.

Figure 5:
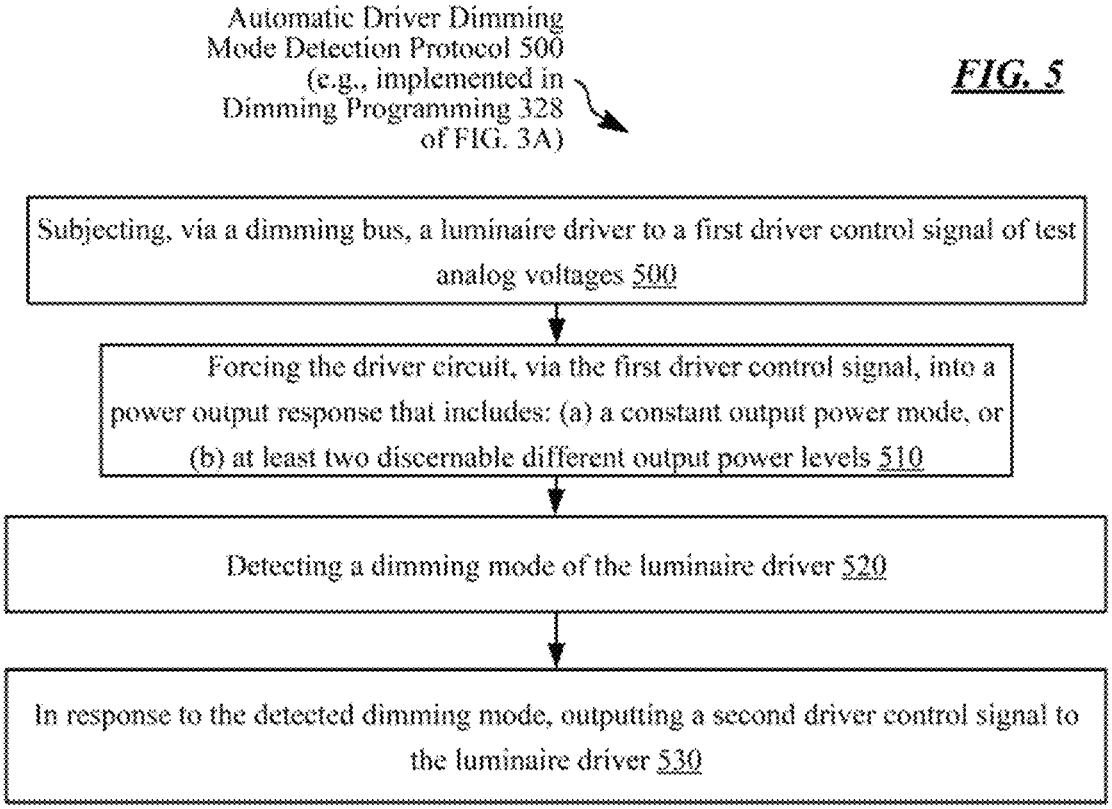
FIG. 5 is an automatic driver dimming mode detection protocol procedure for detecting a dimming mode of a luminaire driver of a luminaire.

FIG. 5 is an automatic driver dimming mode detection protocol 500 procedure for detecting a dimming mode of a luminaire driver 110 of a luminaire 10. The automatic driver dimming mode detection protocol 500 is implemented in the dimming programming 328 of the dimming controller 115.

Beginning in step 500, the automatic dimming mode detection protocol 500 includes subjecting, via a dimming bus 370, a luminaire driver 110 to a first driver control signal 392A of test analog voltages 393A-P. Continuing to step 510, the automatic dimming mode detection protocol 500 includes forcing the luminaire driver 110, via the first driver control signal 392A, into a power output response 385 that includes: (a) a constant output power mode, or (b) at least two discernable different output power levels.

Moving to step 520, the automatic dimming mode detection protocol 500 includes detecting a dimming mode of the luminaire driver 110. The step of detecting the dimming mode of the luminaire driver 110 includes the two following sub-steps. First, measuring, via a power metering circuit 375, a power metering measurement 386 corresponding to the power output response 385. Second, based on the power metering measurement 386 of the luminaire driver 110 being: (a) the constant output power mode, determine that the luminaire driver 110 is a digital dimming mode type; or (b) the at least two discernable different output power levels, determine that the luminaire driver 110 is an analog dimming mode type. The sub-step of measuring, via the power metering circuit 375, the power metering measurement 386 includes: measuring a load current 351 via a voltage drop on a first resistor; measuring a self-current 352 via a voltage drop on a second resistor; measuring an input/line voltage 353; or a combination thereof.

The step of detecting the dimming mode of the luminaire driver 110 further includes: based on the at least two discernable different output power levels, determining that the analog dimming mode type includes a linear (LIN) dimming curve response 450 or a logarithmic (LOG) dimming curve response 400. The step of determining that the analog dimming mode includes the LIN dimming curve response 450 is based on the at least two discernable different output power levels varying by approximately a factor of (8×) or approximately 20% or less. The step of determining that the analog dimming mode includes the LOG dimming curve response 400 is based on the at least two discernable different output power levels varying by <2×. The step of detecting the dimming curve of a digital luminaire driver 110 further includes supplementing the first driver control signal 392A with two different direct arc forward frames. In this digital dimming case we have the option of using much higher dimming levels than in the analog dimming case, which will cause at least two discernable different output power levels varying by 20% or less in the LIN case and 70% or more in the LOG case.

Finishing in step 530, in response to the detected dimming mode, outputting a second driver control signal 392B to the luminaire driver 110. The step of outputting the second driver control signal 392B to the luminaire driver 110 includes: (a) based on the digital dimming mode type, selecting, via the steering circuit 380, a digital dimming interface 381A to output the second driver control signal 392B to the luminaire driver 110; or (b) based on the analog dimming mode type, select, via the steering circuit 380, the analog dimming interface 381B to output the second driver control signal 392B to the luminaire driver 110.

Any of the functionality of the automatic driver dimming mode detection protocol 500, including dimming programming 328, described herein for the lighting system elements (e.g., luminaires 10A-B, plug load-controller 30, and power pack 35) of the lighting control system 1 can be embodied in one more applications or firmware as described previously. According to some embodiments, "function," "functions," "application," "applications," "instruction," "instructions," or "programming" are program(s) that execute functions defined in the programs. Various programming languages can be employed to create one or more of the applications, structured in a variety of manners, such as object-oriented programming languages (e.g., Objective-C, Java, or C++) or procedural programming languages (e.g., C or assembly language). In a specific example, a third-party application (e.g., an application developed using the ANDROID™ or IOS™ software development kit (SDK) by an entity other than the vendor of the particular platform) may be mobile software running on a mobile operating system such as IOS™, ANDROID™, WINDOWS® Phone, or another mobile operating system. In this example, the third-party application can invoke API calls provided by the operating system to facilitate functionality described herein.

As used herein, a processor 323 is a hardware circuit having elements structured and arranged to perform one or more processing functions, typically various data processing functions. Although discrete logic components could be used, the examples utilize components forming a programmable central processing unit (CPU). A processor 323 for example includes or is part of one or more integrated circuit (IC) chips incorporating the electronic elements to perform the functions of the CPU.

The applicable processor 323 executes programming or instructions to configure the luminaires 10A-B, etc. to perform various operations. For example, such operations may include various general operations (e.g., a clock function, recording and logging operational status and/or failure information) as well as various system-specific operations (e.g., dimming controller 115) functions. Although a processor 323 may be configured by use of hardwired logic, typical processors in lighting devices or in light responsive devices are general processing circuits configured by execution of programming, e.g., instructions and any associated setting data from the memories 322 shown or from other included storage media and/or received from remote storage media.

Hence, a machine-readable medium may take many forms of tangible storage medium. Non-volatile storage media include, for example, optical or magnetic disks, such as any of the storage devices in any computer(s) or the like, such as may be used to implement the client device, media gateway, transcoder, etc. shown in the drawings. Volatile storage media include dynamic memory, such as main memory of such a computer platform. Tangible transmission media include coaxial cables; copper wire and fiber optics, including the wires that comprise a bus within a computer system. Carrier-wave transmission media may take the form of electric or electromagnetic signals, or acoustic or light waves such as those generated during radio frequency (RF) and infrared (IR) data communications. Common forms of computer-readable media therefore include for example: a floppy disk, a flexible disk, hard disk, magnetic tape, any other magnetic medium, a CD-ROM, DVD or DVD-ROM, any other optical medium, punch cards paper tape, any other physical storage medium with patterns of holes, a RAM, a PROM and EPROM, a FLASH-EPROM, any other memory chip or cartridge, a carrier wave transporting data or instructions, cables or links transporting such a carrier wave, or any other medium from which a computer may read programming code and/or data. Many of these forms of computer readable media may be involved in carrying one or more sequences of one or more instructions to a processor for execution.

Unless otherwise stated, any and all measurements, values, ratings, positions, magnitudes, sizes, angles, and other specifications that are set forth in this specification, including in the claims that follow, are approximate, not exact. Such amounts are intended to have a reasonable range that is consistent with the functions to which they relate and with what is customary in the art to which they pertain. For example, unless expressly stated otherwise, a parameter value or the like may vary by as much as ±5% or as much as ±10% from the stated amount. The term "approximately" or "around" means that the parameter value or the like varies up to ±10% from the stated amount.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," "includes," "including," "has," "having," "containing," "contain", "contains," "with," "formed of," or any other variation thereof, are intended to cover a non-exclusive inclusion, such that a process, method, article, or apparatus that comprises or includes a list of elements or steps does not include only those elements or steps but may include other elements or steps not expressly listed or inherent to such process, method, article, or apparatus. An element preceded by "a" or "an" does not, without further constraints, preclude the existence of additional identical elements in the process, method, article, or apparatus that comprises the element.

In addition, in the foregoing Detailed Description, it can be seen that various features are grouped together in various examples for the purpose of streamlining the disclosure. This method of disclosure is not to be interpreted as reflecting an intention that the claimed examples require more features than are expressly recited in each claim. Rather, as the following claims reflect, the subject matter to be protected lies in less than all features of any single disclosed example. Thus, the following claims are hereby incorporated into the Detailed Description, with each claim standing on its own as a separately claimed subject matter.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present concepts.

The invention claimed is:

1. A luminaire, comprising:
a light source;
a luminaire driver coupled to the light source; and
an on/off and dimming controller coupled to the luminaire driver and configured to control light source operation via the luminaire driver, the on/off and dimming controller including:
a processor;
a memory accessible to the processor;
dimming programming in the memory, wherein execution of the dimming programming by the processor configures the luminaire to perform functions, including functions to:
subject, via the dimming bus, the luminaire driver to a first driver control signal of test analog voltages;
force the luminaire driver, via the first driver control signal, into a power output response that includes: (a) a constant output power mode, or (b) at least two discernable different output power levels;
detect a dimming mode of the luminaire driver, wherein the function to detect the dimming mode of the luminaire driver includes to:
measure, via a power metering circuit, a power metering measurement corresponding to the power output response; and
based on the power metering measurement of the luminaire driver being:
(a) the constant output power mode, determine that the luminaire driver is a digital dimming mode type; or
(b) the at least two discernable different output power levels, determine that the luminaire driver is an analog dimming mode type; and
in response to the detected dimming mode, output a second driver control signal to the luminaire driver.

2. The luminaire of claim 1, wherein:
the constant output power mode produces a constant light output by the light source; and
the at least two discernable different output power levels produce a controllable and measurable light output variation by the light source.

3. The luminaire of claim 1, further comprising:
a steering circuit;
a digital dimming interface; and
an analog dimming interface;
wherein the function to output the second driver control signal to the luminaire driver includes to:
(a) based on the digital dimming mode type, select, via the steering circuit, the digital dimming interface to output the second driver control signal to the luminaire driver; or
(b) based on the analog dimming mode type, select, via the steering circuit, the analog dimming interface to output the second driver control signal to the luminaire driver.

4. The luminaire of claim 1, wherein the function to measure, via the power metering circuit, the power metering measurement includes to:
measure a load current via a voltage drop on a first resistor;
measure a self-current via a voltage drop on a second resistor;
measure an input/line voltage; or
a combination thereof.

5. The luminaire of claim 1, wherein the function to subject, via the dimming bus, the luminaire driver to the first driver control signal includes to:
sequentially apply at two test analog voltages in a reduced voltage range of approximately 0-6.5V as the first driver control signal on the dimming bus.

6. The luminaire of claim 1, wherein:
the detected dimming mode is the analog dimming mode type; and
the function to detect the dimming mode of the luminaire driver further includes to:
based on the at least two discernable different output power levels, determine that the analog dimming mode type includes a linear (LIN) dimming curve response or a logarithmic (LOG) dimming curve response.

7. The luminaire of claim 6, wherein:
the function to determine that the analog dimming mode includes the LIN dimming curve response is based on the at least two discernable different output power levels varying by approximately a factor of eight (8×).

8. The luminaire of claim 6, wherein:
the function to determine that the analog dimming mode includes the LOG dimming curve response is based on the at least two discernable different output power levels varying by approximately a factor of less than two (2×).

9. The luminaire of claim 1, wherein:
the detected dimming mode is the digital dimming mode type; and
the function to detect the dimming curve of the luminaire digital dimming driver further includes to:
supplement the first driver control signal with two additional test analog voltages that are: (1) either the same dimming levels as the test analog voltages applied previously; or (2) sufficiently high enough to cause at least two discernable different output power levels varying by 20% or less in a LIN case and 70% or more in a LOG case.

10. The luminaire of claim 1, further comprising:
a steering circuit;
a digital dimming interface;
wherein the function to output the second driver control signal to the luminaire driver includes to:
in response to determining that the luminaire driver is the digital dimming mode type, convey a DALI signal to the digital dimming interface; and
select, via the steering circuit, a control block signal output of the digital dimming interface that includes a pulse train to output as the second driver control signal.

11. The luminaire of claim 10, wherein:
the digital dimming mode type of the luminaire driver operates in accordance with a digital addressable lighting interface (DALI) protocol.

12. The luminaire of claim 1, further comprising:
a steering circuit;
an analog dimming interface;

wherein the function to output the second driver control signal to the luminaire driver includes to:

in response to determining that the luminaire driver is the analog dimming mode type, convey a pulse width modulation (PWM) signal to the analog dimming interface; and select, via the steering circuit, a control block signal output of the analog dimming interface that includes analog voltages to output as the second driver control signal.

13. The luminaire of claim 12, wherein:

the analog dimming mode type of the luminaire driver operates in accordance with a 0-10V dimming protocol.

14. A method, comprising steps of:

subjecting, via a dimming bus, a luminaire driver to a first driver control signal of test analog voltages;

forcing the luminaire driver, via the first driver control signal, into a power output response that includes: (a) a constant output power mode, or (b) at least two discernable different output power levels;

detecting a dimming mode of the luminaire driver, wherein the step of detecting the dimming mode of the luminaire driver includes:

measuring, via a power metering circuit, a power metering measurement corresponding to the power output response; and based on the power metering measurement of the luminaire driver being:

(a) the constant output power mode, determining that the luminaire driver is a digital dimming mode type; or (b) the at least two discernable different output power levels, determining that the luminaire driver is an analog dimming mode type; and in response to the detected dimming mode, outputting a second driver control signal to the luminaire driver.

15. The method of claim 14, wherein the step of outputting the second driver control signal to the luminaire driver includes:

(a) based on the digital dimming mode type, selecting, via the steering circuit, a digital dimming interface to output the second driver control signal to the luminaire driver; or (b) based on the analog dimming mode type, select, via the steering circuit, an analog dimming interface to output the second driver control signal to the luminaire driver.

16. The method of claim 14, wherein the step of measuring, via the power metering circuit, the power metering measurement includes:

measuring a load current via a voltage drop on a first resistor;

measuring a self-current via a voltage drop on a second resistor;

measuring an input/line voltage; or a combination thereof.

17. The method of claim 14, wherein the step of detecting the dimming mode of the luminaire driver further includes:

based on the at least two discernable different output power levels, determining that the analog dimming mode type includes a linear (LIN) dimming curve response or a logarithmic (LOG) dimming curve response.

18. The method of claim 17, wherein the step of determining that the analog dimming mode includes the LIN dimming curve response is based on the at least two discernable different output power levels varying by approximately a factor of eight (8×).

19. The method of claim 17, wherein the step of determining that the analog dimming mode includes the LOG dimming curve response is based on the at least two discernable different output power levels varying by approximately a factor less than two (2×).

20. The method of claim 14, wherein the step of detecting the dimming curve of a digital luminaire driver further includes supplementing the first driver control signal with two different direct arc forward frames.

* * * * *